US006367332B1

(12) United States Patent
Fisher et al.

(10) Patent No.: US 6,367,332 B1
(45) Date of Patent: Apr. 9, 2002

(54) TRIBOELECTRIC SENSOR AND METHODS FOR MANUFACTURING

(76) Inventors: Joseph R. Fisher, 163 Moore Rd., Sudbury, MA (US) 01776; William C. Booth, 14 Evelyn Rd., Stow, MA (US) 01775; Francis E. McInnis, 162 Woodland Dr., Marlboro, MA (US) 01752

( * ) Notice: Subject to any disclaimer, the term of this patent is extended or adjusted under 35 U.S.C. 154(b) by 0 days.

(21) Appl. No.: 09/459,250

(22) Filed: Dec. 10, 1999

(51) Int. Cl.[7] ..... H04R 23/00

(52) U.S. Cl. ..... 73/649; 73/866.5; 73/432.1; 29/828; 156/54; 156/55; 156/56; 228/129; 228/146; 228/147; 228/148; 310/310; 324/454

(58) Field of Search ..... 73/866.5, 649, 73/432.1; 29/828, 594, 595; 156/54, 55, 56, 47, 51, 52, 53; 174/88 R, 88 C; 228/129, 130, 146, 147, 148; 307/400; 310/308, 309, 310; 324/454; 340/540, 541, 545.4, 550, 565, 566, 596; 381/191

(56) References Cited

U.S. PATENT DOCUMENTS 3,750,127 A * 7/1973 Ayers et al. ..... 340/665
3,803,548 A * 4/1974 Skujins, Jr. ..... 340/566
4,083,484 A * 4/1978 Polizzano et al. ..... 228/130
4,374,299 A * 2/1983 Kincaid ..... 174/36
4,389,580 A * 6/1983 Bendyshe Walton et al. .... 307/400
4,509,527 A * 4/1985 Fraden ..... 600/484
5,560,536 A * 10/1996 Moe ..... 228/102
5,908,361 A * 6/1999 Fisher et al. ..... 473/467
5,926,949 A * 7/1999 Moe et al. ..... 29/828

FOREIGN PATENT DOCUMENTS

WO WO-98/20470 * 5/1998 ..... 340/933

* cited by examiner

*Primary Examiner*—Hezron Williams
*Assistant Examiner*—Rose M. Miller
(74) *Attorney, Agent, or Firm*—Mark P. White

(57) ABSTRACT

Triboelectric sensors which generate electrical signals in response to mechanical disturbances creating relative motion of conducting and dielectric components of the sensor are fabricated from thin metal foil which is plastic-coated on one side and which can be formed into elongated, cable-like sensors having a variety of other shapes and sizes. The foil encloses one or more wire-like inner electrical conductors which, may be sealed within the envelope formed by the outer foil by heat-sealing the plastic-coated foil. A technique similar to welding may be used in which electrodes are placed in contact with opposing faces of the metal foil and an electrical current is passed though the foil. Local heating of the foil and of the plastic coating near the point of contact of one or both electrodes can cause the plastic to melt and the opposing plastic faces to bond together.

15 Claims, 1 Drawing Sheet

TRIBOELECTRIC SENSOR AND METHODS FOR MANUFACTURING

FIELD OF THE INVENTION

This invention relates to the design and manufacture of contact or mechanical disturbance sensors based on the triboelectric principle.

BACKGROUND OF THE INVENTION

Meryman et al (U.S. Pat. No. 2,787,784) disclose a device for detecting mechanical disturbances using a specially constructed electrical cable operating on the triboelectric principle in which the friction associated with relative motion between the several conducting and dielectric components of the cable causes electrical charge to be transferred between the conductors when the cable is disturbed. This transfer of charge can cause a small but readily detectable voltage and current when the sensing cable is connected to an amplifier.

SUMMARY OF THE INVENTION

The general object of this invention is to provide a low-cost means to manufacture triboelectric sensing devices including sensing cable and flat area-sensors. It is a specific object of this invention to provide a type of triboelectric sensor which is very thin and flexible and hence capable of being deployed inconspicuously and to conform to varied surfaces.

When used as part of a tennis line-calling system, inconspicuous deployment can involve being concealed under the surface coating of a hard-surface tennis court, being bonded to the underside of a clay court boundary marking tape or attached to a tennis net. In other applications this type of sensor could be installed under wallpaper or rugs, in upholstery, in driveways and roadways, on the outside or inside of pipes and tanks, in short, in any application where contact or mechanical disturbance is to be sensed and the sensor must be thin but otherwise may have any shape including very long (hundreds or even thousands of feet) and/or wide (up to several feet).

According to one aspect of the invention, a triboelectric sensor for detecting mechanical motion or vibration includes one or more inner electrical conductors, dielectric material surrounding said conductors, and an outer conductor made of metallic foil, surrounding the dielectric material.

According to a second aspect of the invention, the dielectric material is a plastic-coating on the metallic foil of the outer conductor.

According to a third aspect of the invention, the outer conductor is formed into a sealed tube.

According to a fourth aspect of the invention, the sensor is formed into a cable-like configuration.

According to a fifth aspect of the invention, the sensor is formed into an flat ribbon-like configuration.

According to a sixth aspect of the invention, the sensor is formed into an area sensor configuration.

According to a seventh aspect of the invention, a method for manufacturing a triboelectric sensor includes forming one or more inner electrical conductors, surrounding the conductors with dielectric material, and surrounding the dielectric material with an outer conductor made of metallic foil.

According to an eighth aspect of the invention, the surrounding said conductors with dielectric material further comprises coating said metallic foil with a plastic-coating.

According to a ninth aspect of the invention, the method further includes forming the plastic-coated metallic foil into a sealed tube by folding the metallic foil around the inner conductors, creating an open edge, and heat-sealing the open edge of the folded foil.

According to a tenth aspect of the invention, the heat sealing further includes passing an electrical current from a first electrode into the metallic foil, and passing the electrical current from the metallic foil through a second electrode.

According to an eleventh aspect of the invention, the electrodes are made largely of graphite.

According to a twelfth aspect of the invention, the method further includes forming the graphite electrodes into pencil-like elements.

According to a thirteenth aspect of the invention, the method further includes forming the sensor into a cable-like configuration.

According to a fourteenth aspect of the invention, the method further includes forming the sensor into a flat ribbon-like configuration.

According to a final aspect of the invention, the method further includes forming the sensor into an area sensor configuration.

DETAILED DESCRIPTION OF THE PREFERRED EMBODIMENTS

Figure 1:
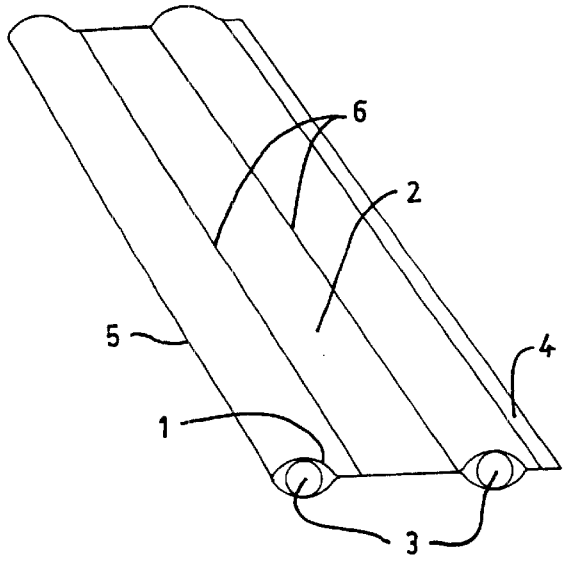
FIG. 1 shows an end-on view of a cable-like sensor made using the techniques of this invention.
Figure 3:
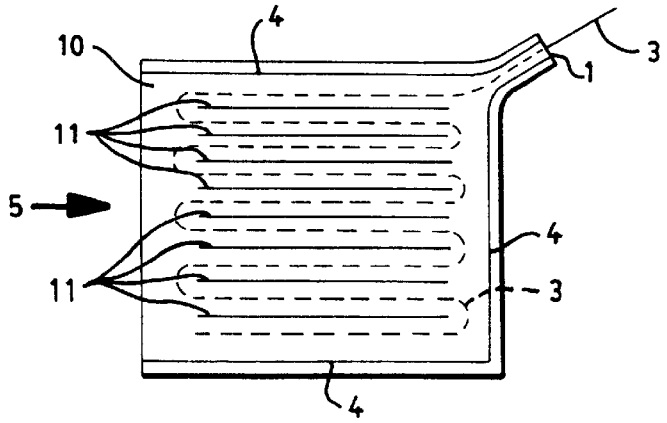
FIG. 3 shows an area sensor made using the techniques of this invention.

According to this invention, the cable sensor 2 in FIG. 1 or the area sensor 10 of FIG. 3 is formed from thin, metallized plastic film 1 together with thin wire for the center conductor or conductors 3. The metallized film 1 is available as a standard industrial product in varying thicknesses from a fraction of a mil (one thousandth of an inch) to several mils with metal coatings ranging down to a small fraction of a mil. The film 1 is available in rolls with widths from a fraction of an inch to several feet. The center conductor 3 can also be made from the same metallized film or thin wire, such as magnet wire, can be used. Although magnet wire is somewhat thicker than the film (a few mils versus 1 mil or less) magnet wire is preferred because it has very durable insulation.

The sensor 2 or 10 is formed by folding the film in half in one dimension (after slitting to proper width if necessary), enclosing the center conductor 3 (or conductors, if more than one is used) within the folded assembly. When two center conductors 3 are used in a cable-like sensor, it is preferred that one runs along the open edge 4 which is to be heat sealed and the other along the folded edge 5. Additional heat seals 6 may be added to restrain the center conductors from significant movement. Heat sealing in multiple places also increases the ability of the assembly to withstand shear forces when the assembly is installed under a thin covering layer such as under the surface coating of a hard-surface tennis court.

In folding, the metallized surface of the film is on the outside and the plastic surface is on the inside. After folding, the open edge 4 is heat sealed, fusing the facing plastic surfaces together.

Figure 2:
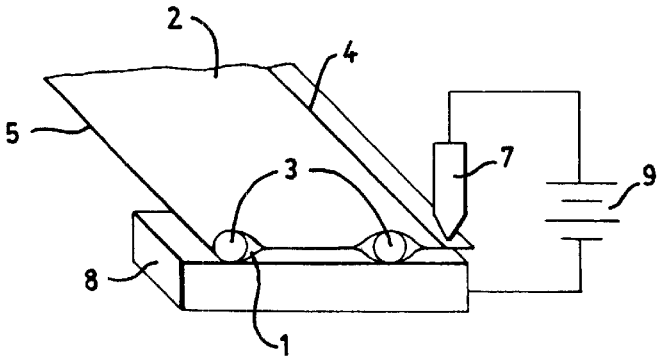
FIG. 2 shows the preferred method of heat sealing the sensor assembly using an electrical current.

When folded and sealed, the metallized film 1 forms the outer electrical shield of the assembly with the enclosed wire(s) 3 forming the center conductor(s). Many methods of heat sealing are used in industry and many would be suitable for performing the heat sealing used in this assembly. The preferred method makes use of the fact that the folded assembly 2 or 10 has metal on the opposing outside surfaces of the film and fusible plastic on the opposing inside surfaces which are to be fused. Heat sealing as shown in FIG. 2 is accomplished by pressing a small electrode 7 against the metallized outer surface of the foil 1 at the point to be sealed and pressing another electrode 8 elsewhere in contact with the foil 1—either another small electrode in direct opposition to the first or an electrode having considerable larger surface area against any other part of the foil 1. A source of electrical current 9 is connected to the electrodes causing a current to flow from the first electrode 7, through the metal of the film 1, to the other electrode 8. The contact resistance between the first electrode 7 and the metal coating on the film 1 causes local heating of the metal at the point of contact of the small electrode(s) and consequently of the plastic surfaces which fuse together as a result. With proper adjustment of the applied voltage, proper current limiting and with proper duration of the current, a strong bond is formed between the plastic surfaces without damaging the metal surface. The proper adjustment of the voltage, current and time duration depend on the configuration, size and material of the electrodes 7 and 8 and the type of metal and plastic in the film. With film made of 1 mil thick polypropylene and 0.3 mil aluminum and with a smaller electrode 7 of soft graphite composite (#2 lead pencil) having a contact area of about 0.01 square inch and a larger aluminum electrode 8 having a contact area of 1 square inch or more, using an applied voltage of 10 volts with current limited to 3 amperes, allows continuous sealing when the small electrode (where the heating takes place) is moved at a rate of about six inches per second. Higher current can be used with a larger electrode contact area or with higher rates of sealing. Soft graphite rods (e.g., soft lead pencils) serve well as the electrodes, and in particular as the smaller electrode, because the contact resistance allows for good heating of the film and the graphite glides smoothly over the metallized foil without tearing.

After the assembly 2 or 10 is heat sealed, a thin protective coating may be applied to the assembly. This coating can be polyurethane or other material which can be applied in a liquid form with low viscosity and will solidify to a thin but tough coating.

When formed as a cable 2, i.e., when the sensor assembly is very long compared to its width, the sensor assembly can be made in a continuous process, folding the foil 1, inserting the center conductor(s) 3, heat sealing and even coating. The resulting sensor cable assembly 2 can be wound on a take-up reel and cut to length as needed for the ultimate application. A connector is added to one or both ends after cutting to length. The center conductor(s) 3 of the formed sensor is connected to the center conductor of the connector and the foil 1 of the sensor is connected to the shield of the connector. A cut end without a connector can be sealed by tucking the cut ends of the center conductor inside the assembly, away from the cut end, and heat sealing across the cut end. The protective coating can be applied to the completed sensor assembly rather than to the continuous cable stock.

Area sensors 10 are made by the same methods as cable-like sensors but not in continuous lengths. To achieve uniform contact sensitivity over the entire area of the sensor, the center conductor(s) 3 should be arranged within the foil shield 1 so that no point on the surface area of the assembly 10 is far from an enclosed conductor 3. Area sensors 10 should be heat sealed not only along the open edges 4 but along lines or at points 11 over the area so as to prevent any significant rearrangement of the enclosed conductor(s) 3 within the assembly. As with cable sensors, an electrical connector is attached to the end of the area sensor and the entire assembly may be given a protective coating.

Although specific features of this invention are shown in some drawings and not others, this is for convenience only as each feature may be combined with any or all of the other features in accordance with the invention.

Other embodiments will occur to those skilled in the art and are within the scope of this invention.

What is claimed is:

1. A triboelectric sensor for detecting mechanical motion or vibration comprising:

a) one or more inner electrical conductors;

b) dielectric material surrounding said one or more inner electrical conductors; and c) an outer conductor, further comprised of metallic foil, surrounding said dielectric material, whereby the friction associated with relative motion between the one or more inner electrical conductors, the dielectric material, and the outer conductor causes electrical charges to be transferred between the inner and outer conductors when the sensor is disturbed.

2. The sensor of claim 1 wherein said dielectric material further comprises a plastic-coating on the metallic foil of the outer conductor.

3. The sensor of claim 2 wherein said outer conductor is formed into a sealed tube.

4. The sensor of claim 1 wherein the sensor is formed into a cable.

5. The sensor of claim 1 wherein the sensor is formed into a flat ribbon.

6. The sensor of claim 1 wherein the sensor is formed into an area sensor configuration.

7. A method for manufacturing a triboelectric sensor comprising:

a) forming one or more inner electrical conductors;

b) surrounding said one or more inner electrical conductors with dielectric material; and c) surrounding said dielectric material with an outer conductor further comprising metallic foil, whereby the sensor is formed such that the friction associated with relative motion between the one or more inner electrical conductors, the dielectric material, and the outer conductor causes electrical charges to be transferred between the inner and outer conductors when the sensor is disturbed.

8. The method of claim 7, wherein said surrounding said conductors with dielectric material further comprises coating said metallic foil with a plastic-coating.

9. The method of claim 8, further comprising:

a) forming said plastic-coated metallic foil into a sealed tube by folding said metallic foil around said inner conductors; creating an open edge thereby, and b) heat-sealing the open edge of the folded foil.

10. The method of claim 9, wherein said heat sealing further comprises:

a) passing an electrical current from a first electrode into said metallic foil; and b) passing said electrical current from said metallic foil through a second electrode.

11. The method of claim 10, wherein said electrodes are made largely of graphite.

12. The method of claim 11 wherein said graphite electrodes are comprised of pencil-shaped elements.

13. The method of claim 7, further comprising forming the sensor into a cable.

14. The method of claim 7, further comprising forming the sensor into a flat ribbon.

15. The method of claim 7, further comprising forming the sensor into an area sensor configuration.

* * * * *